US010646873B2

(12) United States Patent
Somada et al.

(10) Patent No.: US 10,646,873 B2
(45) Date of Patent: May 12, 2020

(54) MULTI-WELL PLATE LID AND MULTI-WELL PLATE

(71) Applicants: Hiroki Somada, Shizuoka (JP); Satoshi Izumi, Tokyo (JP); Takahiko Matsumoto, Kanagawa (JP); Daisuke Takagi, Kanagawa (JP)

(72) Inventors: Hiroki Somada, Shizuoka (JP); Satoshi Izumi, Tokyo (JP); Takahiko Matsumoto, Kanagawa (JP); Daisuke Takagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 15/846,393

(22) Filed: Dec. 19, 2017

(65) Prior Publication Data

US 2018/0169650 A1 Jun. 21, 2018

(30) Foreign Application Priority Data

Dec. 19, 2016 (JP) ..... 2016-245889
Oct. 26, 2017 (JP) ..... 2017-207058

(51) Int. Cl.
*B01L 3/00* (2006.01)

(52) U.S. Cl.
CPC ... *B01L 3/50853* (2013.01); *B01L 2200/0689* (2013.01); *B01L 2200/087* (2013.01); *B01L 2300/041* (2013.01); *B01L 2300/0829* (2013.01); *B01L 2300/123* (2013.01); *B01L 2300/165* (2013.01)

(58) Field of Classification Search
CPC ..... B01L 3/50853; B01L 2200/0689; B01L 2300/0829; B01L 2200/087; B01L 2300/041; B01L 2300/123; B01L 2300/165
See application file for complete search history.

(56) References Cited

U.S. PATENT DOCUMENTS

2002/0172621 A1* 11/2002 Barbera-Guillem ..... B01L 3/50853 422/503
2003/0077207 A1* 4/2003 Tyndorf ..... B01L 3/50853 422/400
2003/0077440 A1* 4/2003 Razavi ..... B32B 15/08 428/343

(Continued)

FOREIGN PATENT DOCUMENTS

JP 2002-159284 6/2002
JP 2003-070456 3/2003

(Continued)

OTHER PUBLICATIONS

Excel Scientific, Inc. "Seal Plate Sealing Films" webpage, retrieval date Nov. 12, 2016 by web.archive.org (Year: 2016).*

(Continued)

*Primary Examiner* — Jill A Warden
*Assistant Examiner* — Quocan B Vo
(74) *Attorney, Agent, or Firm* — Oblon, McClelland, Maier & Neustadt, L.L.P.

(57) ABSTRACT

A multi-well plate lid includes a well-side surface to cover a plurality of wells of a multi-well plate. The well-side surface includes two or more regions with different adhesive strengths to the multi-well plate.

18 Claims, 10 Drawing Sheets

(56) References Cited

U.S. PATENT DOCUMENTS

| | | | | |
|---|---|---|---|---|
| 2003/0134033 | A1* | 7/2003 | Holguin | B01J 19/0046 427/8 |
| 2004/0033539 | A1* | 2/2004 | Schnabel | G01N 33/5008 435/7.21 |
| 2004/0112529 | A1* | 6/2004 | Karlsson | B01J 19/0093 156/306.6 |
| 2006/0004526 | A1* | 1/2006 | Hadd | G16B 45/00 702/20 |
| 2006/0029948 | A1* | 2/2006 | Lim | B01L 3/50853 435/6.19 |
| 2012/0230892 | A1* | 9/2012 | Peterson | B01L 3/50853 422/552 |

FOREIGN PATENT DOCUMENTS

| | | |
|---|---|---|
| JP | 2007-325536 | 12/2007 |
| JP | 2011-047754 | 3/2011 |
| WO | WO96/039481 | 12/1996 |
| WO | WO2006/059701 | 6/2006 |
| WO | WO2007/028861 | 3/2007 |

OTHER PUBLICATIONS

Nitto "Multi-adhesive Tape with Different Adhesive Properties NF Tape" webpage, retrieval date Jul. 9, 2014 by web.archive.org (Year: 2014).*

FluidX, "NEW AirFilm Starter Pack—A Unique way to individually seal Sample Storage Tubes" uploaded to www.youtube.com, published Oct. 2, 2013 (Year: 2013).*

* cited by examiner

MULTI-WELL PLATE LID AND MULTI-WELL PLATE

CROSS-REFERENCE TO RELATED APPLICATION

This patent application is based on and claims priority pursuant to 35 U.S.C. § 119(a) to Japanese Patent Application Nos. 2016-245889, filed on Dec. 19, 2016, and 2017-207058, filed on Oct. 26, 2017 in the Japan Patent Office, the entire disclosure of each of which is hereby incorporated by reference herein.

BACKGROUND

Technical Field

Aspects of the present disclosure relate to a multi-well plate lid and a multi-well plate.

Related Art

In the field of biotechnology, multi-well plates are used for, e.g., inspection, analysis, and preservation.

SUMMARY

In an aspect of the present disclosure, there is provided a multi-well plate lid that includes a well-side surface to cover a plurality of wells of a multi-well plate. The well-side surface includes two or more regions with different adhesive strengths to the multi-well plate.

In another aspect of the present disclosure, there is provided a multi-well plate lid that includes a perforation disposed between adjacent wells of a plurality of wells of a multi-well plate; and an adhesive member to adhere the multi-well plate and the multi-well plate lid. In still another aspect of the present disclosure, there is provided a multi-well plate lid set that includes a multi-well plate lid to cover a plurality of wells of a multi-well plate; and a cover sheet disposed on a first surface of the multi-well plate lid opposite a second surface of the multi-well plate lid facing the multi-well plate. The second surface includes a region having a higher viscosity or a greater adhesive strength than the cover sheet.

In still yet another aspect of the present disclosure, there is provided a multi-well plate that includes a plurality of wells; and the multi-well plate lid covering the plurality of wells.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1A:
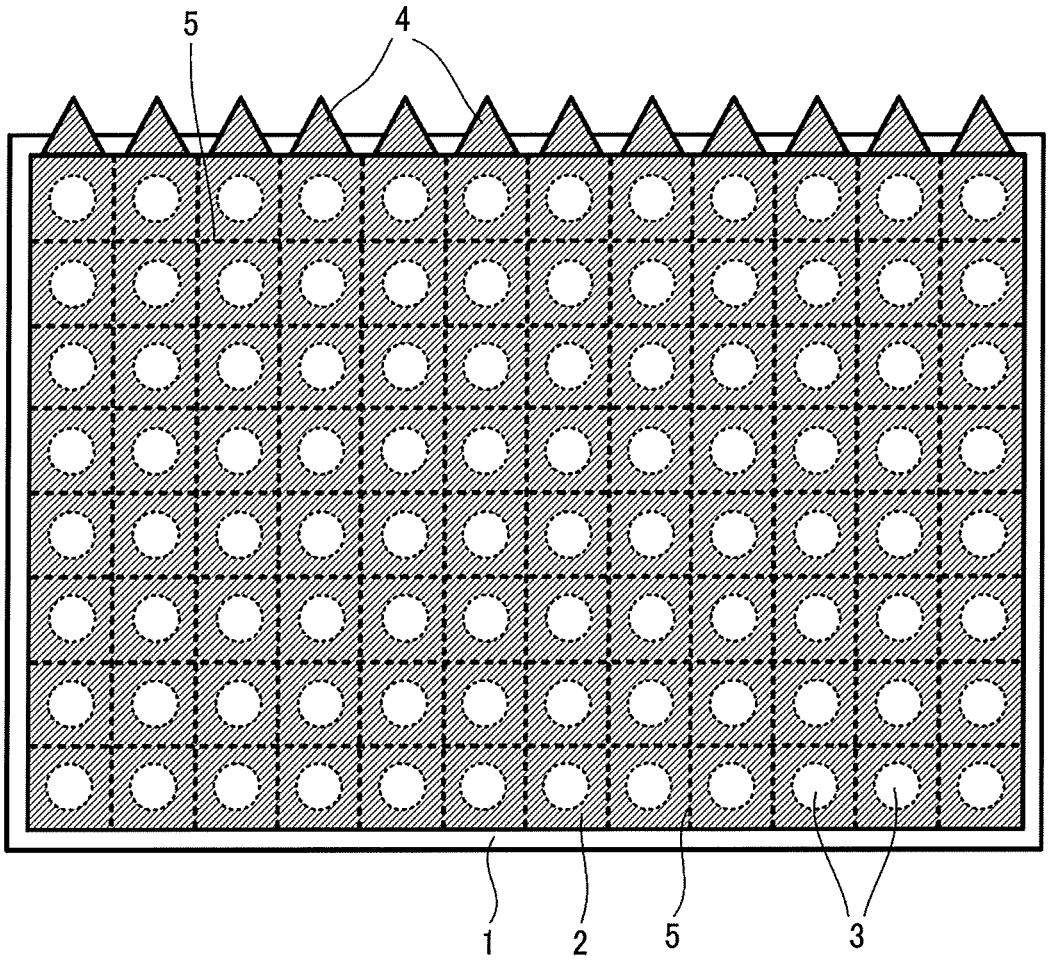
FIG. 1A is a plan view of a multi-well plate having a multi-well plate lid according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure are described with reference to attached drawings. Note that embodiments are not limited to the embodiments described below, but can be appropriately modified without departing from the gist of the present invention. In the following description, a side (top-plate side) of an image projection apparatus closer to a top plate is referred to as "upper" or "above", and a side (heat-sink side) of the image projection apparatus closer to a heat sink may be referred to as "lower" or "below".

Multi-Well Plate Lid

A multi-well plate lid according to an embodiment of the present disclosure is a multi-well plate lid to cover a plurality of wells of a multi-well plate and has two or more regions with different adhesive strengths to the multi-well plate. In the multi-well plate lid, the adhesive strength of a covering portion to cover wells containing particles is preferably greater than the adhesive strength of a covering portion to cover other wells. The adhesive strength can be measured by a known method, such as a peeling test using a tensile tester.

In the present embodiment, among the plurality of wells, wells containing particles are sealed, and wells not containing particles can be unsealed. Such a configuration can prevent erroneous use of wells containing a known number of copies of particles in the multi-well plate, thus allowing use of some wells of the multi-well plate.

For a typical multi-well plate covered with a cover sheet, there is no problem in using all of a plurality of wells of the multi-well plate. However, when some wells of the multi-well plate are used, it might be difficult to peel off (unseal) the multi-well plate lid and cause contamination in contents in wells due to vibration in peeling off (unsealing) the multi-well plate lid. Accordingly, it is difficult to partially use some wells of the multi-well plate. The multi-well plate lid according to embodiments of the present disclosure is based on such findings. The multi-well plate lid according to embodiments of the present disclosure is also based on the finding that, for a typical technique of disposing an inner lid made of elastomer between a multi-well plate and a cover sheet, the multi-well plate and the inner lid made of elastomer adhere tightly to each other, thus making it difficult to easily peel off (unseal) the inner lid. The multi-well plate lid according to embodiments of the present disclosure is also based on the finding that, when a prepared multi-well plate is frozen and stored, the multi-well plate and the inner lid more tightly adhere to each other, thus making it difficult to peel off the inner lid. The multi-well plate lid according to embodiments of the present disclosure is also based on the findings that, for a container having a typical sheet with dividing lines, the sheet with the dividing lines is not made of elastomer and sufficient adhesion to the multi-well plate may not be obtained, and it is not easy to peel off the sheet for each well or for each row of wells only by providing the dividing lines on the sheet. The multi-well plate lid according to embodiments of the present disclosure is also based on the findings that, for a method of sealing a container with a typical cover sheet, since a cover sheet is entirely peeled off to expose all the wells when the cover sheet is peeled off to dispense a reagent, the mix-up of wells containing the reagent and wells not containing the reagent are more likely to occur, and in such a case, it is unnecessary to peel off the cover sheet for wells containing a known number of copies in, e.g., an examination by an amplification reaction using a polymerase chain reaction (PCR) method.

<Multi-Well Plate Lid>

A multi-well plate lid covering a plurality of wells of a multi-well plate preferably includes perforations, an adhesive member, protruding portions, and, as needed, other members.

The material, shape, size, and structure of the multi-well plate lid are not particularly limited and can be appropriately selected according to the purpose. The material of the multi-well plate lid is not particularly limited and may be appropriately selected according to the purpose. For example, an elastomer is preferable. The elastomer is excellent in chemical resistance and has good sealing as a lid. A lid of elastomer can be used without adhering the lid to a multi-well plate with an adhesive like a cover sheet. The elastomer is not particularly limited and may be appropriately selected according to the purpose. Examples of elastomer include, but not limited to, various thermoplastic elastomers, synthetic rubbers, such as butadiene rubber, styrene-butadiene rubber, high styrene rubber, isoprene rubber, acrylic rubber, epichlorohydrin rubber, butyl rubber, and ethylene-propylene rubber, and natural rubber. The above-described examples may be used alone, or two or more of the examples may be used in combination. When the material of the multi-well plate lid is transparent, there is an advantage that the inside of the well (for example, can evaluate the fluorescence intensity) can be observed even after sealing. Generally, a pipette is used to dispense a reagent. However, when a resin having a self-repairing function is used as the material of the multi-well plate lid, for example, a syringe can be used to insert a needle into a well of the multi-well plate lid to dispense the reagent. Such a configuration can dispense the reagent without peeling off the multi-well plate lid.

The shape of the multi-well plate lid is not particularly limited and can be appropriately selected according to the purpose. Examples of the shape include, but not limited to, a sheet shape and a plate shape. The average thickness of the multi-well plate lid is preferably in a range of 0.5 mm or more and 3 mm or less. In the range of the average thickness, sufficient elasticity and good sealing property can be obtained. The structure of the multi-well plate lid is not particularly limited and may be appropriately selected according to the purpose. For example, the structure may be a single-layer structure or a multi-layer structure.

A well-side surface of the multi-well plate lid is preferably water-repellent treated with a water repellent material. Such a configuration can prevent, e.g., dispensed liquid or cells from adhering to the multi-well plate lid. Examples of the water repellent material include, but not limited to, fluororesin. Examples of fluororesin include, but not limited to, polytetrafluoroethylene (PTFE), tetrafluoroethylene-perfluoroalkylvinylether copolymer, tetrafluoroethylene-hexafluoropropylene copolymer, tetrafluoroethylene-ethylene copolymer, tetrafluoroethylene-vinylidene fluoride copolymer, tetrafluoroethylene-hexafluoropropylene-perfluoroalkyl vinyl ether copolymer, polychlorotrifluoroethylene, chlorotrifluoroethylene-ethylene copolymer, chlorotrifluoroethylene-vinylidene fluoride copolymer, polyvinylidene fluoride, and polyvinyl fluoride. The above-described examples may be used alone, or two or more of the examples may be used in combination.

<Perforations>

The multi-well plate lid includes perforations between adjacent wells of a plurality of wells. The perforations may be referred to as cutting lines or dividing lines. The pitch and size of perforations are not particularly limited and can be appropriately selected according to the purpose. When a peeling jig or the like is used, for example, the perforation size is preferably set to 0.1 mm or more and 0.4 mm or less. In cutting by hand without using a peeling jig or the like, the multi-well plate lid can be easily cut when the perforation size is approximately 2 mm or more and approximately 3 mm or less. The perforation pitch is preferably substantially equal to the size of the perforation. It is preferable to peel off the multi-well plate lid for each well. Such a configuration is preferable in that individual wells can be used independently. It is preferable to peel off the multi-well plate lid for each well row in at least one of the longitudinal direction and the width direction of the multi-well plate. Such a configuration allows the multi-well plate lid to be peeled-off for each well row to use the multi-well plate.

<Protruding Portion>

The protruding portions protrude from an end of the multi-well plate lid. The material, shape, size, and structure of the protruding portion are not particularly limited and can be appropriately selected according to the purpose. The material of the protruding portion is not particularly limited and can be appropriately selected according to the purpose. When the material of the protruding portion is a material (elastomer) different from the multi-well plate lid, for example, there is an advantage that it is easy to grasp the protruding portion to peel the sheet. On the other hand, when the material of the protruding portion is the same material (elastomer) as the multi-well plate lid, it is easy to mold the multi-well plate lid, which is advantageous from the viewpoint of cost. As the shape of the protruding portion, a shape that is easily gripped with a finger or a peeling jig is preferable. Examples of the shape include a triangle, a square, a rectangle, a circle, an ellipse, and a semicircle. The size and structure of the protruding portion are not particularly limited and can be appropriately selected according to the purpose. The multi-well plate lid with the protruding portions allows each protruding portion to be gripped with a finger or a peeling jig so that the multi-well plate lid can be easily peeled off for each well or well row. It is preferable that the protruding portions are disposed along at least one of an end of the multi-well plate in the longitudinal direction of the multi-well plate and another end of the multi-well plate in the width direction of the multi-well plate.

<Adhesive Member>

The adhesive member is not particularly limited as long as the adhesive member can bond the multi-well plate and the multi-well plate lid, and can be appropriately selected according to the purpose. The adhesive member is preferably formed by applying an adhesive material to inter-well portions, which the multi-well plate lid is to contact, of wells from which the multi-well plate lid need not be peeled. The adhesive material is not particularly limited and can be appropriately selected according to the purpose. Examples of the adhesive material include adhesives, such as rosin derivative, terpene resin, petroleum resin, acrylic resin, phenol resin, and xylene resin.

The multi-well plate lid according to an embodiment of the present disclosure may have a configuration in which a plurality of wells of a multi-well plate are covered with a multi-well plate lid having a projecting shape. The projecting shape is formed by pressing the multi-well plate lid with a projecting member. Accordingly, the multi-well plate lid is deformed to reduce the volume of the well. When the volume of the well is smaller than the amount of a reagent dispensed into the well, it is possible to restrict the movement of dispensed liquid during the transport of the multi-well plate, thus preventing, e.g., cells in the dispensed liquid from adhering to an upper part of the well. When the multi-well plate is transported after a reagent is dispensed and frozen, it is possible to restrict the movement of liquid in the well, thus suppressing damage to the dispensed liquid. When the projecting member is removed, the multi-well plate lid restores from the projecting shape to the sheet shape and turns into a usable state.

Multi-Well Plate

The multi-well plate according to an embodiment of the present disclosure includes a plurality of wells covered with the multi-well plate lid according to an embodiment of the present disclosure. The multi-well plate according to an embodiment of the present disclosure may further includes other members as needed.

The multi-well plate is a plate-shaped member having a plurality of wells. The material, shape, size, and structure of the multi-well plate are not particularly limited and can be appropriately selected according to the purpose. The material of the multi-well plate is not particularly limited and can be appropriately selected according to the purpose. Examples of the material include, but not limited to, semiconductors, ceramics, metals, glass, quartz glass, and plastics. Of the above-described examples, plastics are preferable. Examples of plastics include, but not limited to, polypropylene resin and polystyrene resin.

The shape of the multi-well plate is not particularly limited and may be appropriately selected according to the purpose. For example, a plate shape is preferable. The structure of the multi-well plate is not particularly limited and may be appropriately selected according to the purpose. For example, the structure may be a single-layer structure or a multi-layer structure. The number of wells in the multi-well plate is plural, preferably 2 or more, more preferably 5 or more. For example, the multi-well plate having 24, 48, 96 or 384 wells is used.

The shape of the well is not particularly limited and may be appropriately selected according to the purpose. Examples of the shape include, but not limited to, flat bottom, round bottom, U bottom, and V bottom.

In the multi-well plate according to an embodiment of the present disclosure, particles are preferably contained in a plurality of wells.

Examples of particles include, but not limited to, cells, substances containing nucleotides as constituents, substances containing amino acids as constituents, inorganic fine particles, and organic polymer particles. Among the above-described examples, (1) cells, (2) substances containing nucleotides as constituents, and (3) substances containing amino acids as constituents are preferable.

(1) The type and so forth of the cell is not particularly limited and can be appropriately selected according to the purpose. In terms of taxonomy, all types of cells are usable regardless of whether the cells are, for example, eukaryotic cells, prokaryotic cells, multicellular organism cells, or unicellular organism cells. The above-described examples may be used alone, or two or more of the examples may be used in combination. Among the cells, microorganisms having a cell wall and easy to handle are preferable. The term "microorganism" means any unknown and known microscopic organism existing in the natural world and includes, for example, bacteria, fungi, protozoa, and virus. Examples of eukaryotic cells include, but not limited to, animal cells, insect cells, plant cells, and fungi. The examples may be used alone, or two or more of the examples may be used in combination. Among the above-described examples, animal cells are preferable. Animal cells are not particularly limited and may be appropriately selected according to the intended purpose. Examples of the animal cells include, but not limited to, differentiated cells and undifferentiated cells. Examples of differentiated cells include, but not limited to, hepatocytes that are parenchymal cells of the liver; stellate cells; Kupffer cells; vascular endothelial cells; endothelial cells, such as ductal endothelial cells and corneal endothelial cells; fibroblasts; osteoblasts; periodontal ligament fibroblasts; Epithelial cells, such as epidermal keratinocytes; tracheal epithelial cells; gastrointestinal epithelial cells; cervical epithelial cells; epithelial cells such as corneal epithelial cells; mammary gland cells; pericytes; muscle cells, such as smooth muscle cells and cardiac muscle cells; renal cells; pancreatic islets of Langerhans cells; peripheral nerve cells, nerve cells, such as optic nerve cells; cartilage cells; and bone cells. Animal cells may be primary cells taken directly from tissues or organs or may be passaged for several generations. Of the above-described examples, for example, fibroblasts and cervical epithelial cells are preferable. The undifferentiated cells are not particularly limited and can be appropriately selected according to the purpose. Examples of the undifferentiated cells include, but not limited to, pluripotent stem cells, such as embryonic stem cells being undifferentiated cells and multipotent mesenchymal stem cells; monocytogenic stem cells, such as unipotent, vascular endothelial progenitor cells; and iPS cells. Examples of fungi include, but not limited to, fungi and yeast. The above-described examples may be used alone, or two or more of the examples may be used in combination. Among the above-described examples, yeast is more preferable. Prokaryotic cells include, for example, eubacteria and archaebacteria. The above-described examples may be used alone, or two or more of the examples may be used in combination.

(2) Examples of substances including nucleotides as constituents include, but not limited to, nucleic acids, such as RNA (ribonucleic acid) having ribonucleotides as constituents and DNA (deoxyribonucleic acid) comprising deoxyribonucleotides as constituents, fragments of the nucleic acids, and analogues of the nucleic acids or the fragments. The substances including nucleotides are not limited to any particular length and may be single-stranded or double-stranded. The examples of the substances including nucleotides include, but not limited to, relatively short-chain oligos or polynucleotides used as, for example, primers, probes, and siRNAs (small interfering RNAs); and long-chain polynucleotides, such as genes (including mRNA) and plasmids. Examples of the analogues of nucleic acids or nucleic acid fragments include, but not limited to, an analogue in which a non-nucleic acid component is bound to a nucleic acid or a nucleic acid fragment; an analogue in which a nucleic acid or a nucleic acid fragment is labeled with a labeling agent, such as a fluorescent dye or an isotope (for example, a primer or probe labeled with a fluorescent dye or a radioactive isotope; and an analogue (for example, a peptide nucleic acid) in which the chemical structure of a part of nucleotides constituting a nucleic acid or a nucleic acid fragment has been changed. The substances including nucleotides may be natural products obtained from living organisms or processed products of natural substances. Alternatively, the substances including nucleotides may be produced using genetic recombination technology or may be chemically synthesized.

(3) Examples of substances containing amino acids as constituents include, but not limited to, peptides containing amino acids as constituents, proteins, and derivatives of the peptides or proteins. The type of amino acids constituting the peptide or protein and the three-dimensional structure of the protein are not particularly limited and can be appropriately selected according to the purpose. Examples of proteins include, but not limited to, simple proteins composed only of amino acids, complex proteins in which non-protein substances are bound to simple proteins, and polymeric substances in which a plurality of simple proteins and complex proteins are associated as subunits. Examples of simple proteins include, but not limited to, albumin, globulin, prolamin, glutelin, histone, protamine, and hard protein. Examples of complex proteins include, but not limited to, chromoproteins, such as hemoglobin; glycoprotein bound to carbohydrate; lipoprotein bound to lipid, nucleoprotein bound to nucleic acid, phosphoprotein bound to phosphorus, and metalloprotein bound to metal. The type of protein is not particularly limited and can be appropriately selected according to the purpose. Examples of the protein include, but not limited to, fibrous proteins (e.g., keratin, collagen, and fibroin) and globular proteins, which are classified according to the shape of molecule; intracellular proteins, membrane proteins, secreted proteins, and blood proteins, which are classified by localization; enzyme proteins, hormone proteins, receptor proteins, immunoproteins (such as antibodies), and molecular weight marker proteins, which are classified by function. Examples of derivatives of proteins include, but not limited to, derivatives in which a simple protein or complex protein has been partially hydrolyzed; derivatives having been coagulated by heat (coagulated protein); derivatives in which a non-protein substance is bound to the above-described protein (for example, proteins labeled with fluorescent dyes or isotopes); and derivatives in which the chemical structure of a side chain of an amino acid residue has been changed. Examples of derivatives of peptides include, but not limited to, derivatives in which a nonpeptide is bound to a peptide (for example, a peptide labeled with, e.g., a fluorescent dye or an isotope); and derivatives in which the chemical structure of a side chain of an amino acid residue has been changed. Specific examples of the derivatives of peptides include, but not limited to, an antibody enzyme complex (for example, an anti-digoxigenin (DIG)-alkaline phosphatase (AP)-bound antibody) obtained by chemically crosslinking an antibody and an enzyme, and an antibody fluorescent dye complex. The proteins, peptides, or derivatives thereof may be natural products obtained from living organisms or processed products thereof. Alternatively, the proteins, peptides, or derivatives thereof may be produced by using genetic recombination technology or chemically synthesized. Among them, antibodies, enzymes, blood proteins, molecular weight marker proteins, antibody enzyme complexes, antibody fluorescent dye complexes can be suitably exemplified.

Among the above-described particles, cells and DNAs having specific nucleotide sequences are particularly preferable.

The particles contained in the plurality of wells preferably are at least cells and the number of cells accommodated in the plurality of wells is preferably a counted known number.

The particles contained in the plurality of wells are preferably at least DNAs having specific nucleotide sequences and that the number of copies of DNA having specific nucleotide sequence contained in the plurality of wells is preferably a counted known number.

Cells containing a known number of copies of DNA can be contained in a specific well in the multi-well plate. For this purpose, for example, the multi-well plate is used to detect the limit of detection (LOD) in a DNA amplification test by PCR method. For wells that contain cells including a known number of copies of DNA, there is no need to peel off the cover sheet of the corresponding wells. Thus, the mix-up of wells and contamination of the well can be prevented by adhering by adhesive processing described later.

Note that the known number of copies means a predetermined number of molecules, and the predetermined number of molecules means the number of copies of the nucleic acid contained in the well in this case.

—Nucleic Acid—

Nucleic acid preferably has a specific nucleotide sequence. The nucleic acid is not particularly limited and can be appropriately selected according to the purpose. Examples of the nucleic acid include, but not limited to, DNA and RNA. The specific nucleotide sequence is not particularly limited and can be appropriately selected according to the purpose. Examples of the specific nucleotide sequence include, but not limited to, nucleotide sequences used for infectious disease tests, nucleotide sequences not present in nature, nucleotide sequences derived from animal cells, and nucleotide sequences derived from plant cells. The examples may be used alone, or two or more of the examples may be used in combination. The nucleic acid is preferably handled in a state of being supported on a carrier. The carrier is not particularly limited and may be appropriately selected according to the intended purpose. Examples of the carrier include, but not limited to, cells and resins. The cell is not particularly limited as long as gene transfer can be performed on the cell, and can be appropriately selected according to the purpose. The cell can be used regardless of the above-mentioned cell type.

—Adhesive Processing—

In the multi-well plate, a well from which the multi-well plate lid need not be peeled (for example, a well not requiring reagent dispensing or a well that contains cells having the above-mentioned known number of copies of DNA), the adhesive processing is preferably performed on inter-well portions, which the multi-well plate lid contact, between the corresponding wells with an adhesive material, to prevent the multi-well plate lid from not being easily unsealed (peeled off). Wells not requiring reagent dispensing are covered with a multi-well plate lid when the multi-well plate lid is peeled off by perforations of the multi-well plate lid and adhesive processing of the wells So that it is possible to prevent erroneous insertion of reagents upon dispensing the reagent. The adhesive processing can be performed by applying an adhesive material to inter-well portions, which the multi-well plate lid is to contact, of wells from which the multi-well plate lid need not be peeled. The adhesive material is not particularly limited and can be appropriately selected according to the purpose. Examples of the adhesive material include adhesives, such as rosin derivative, terpene resin, petroleum resin, acrylic resin, phenol resin, and xylene resin.

<Other Members>

Other members are not particularly limited and can be appropriately selected according to the purpose. Examples thereof include, but not limited to, a cover sheet.

—Cover Sheet—

The material, shape, size, and structure of the cover sheet are not particularly limited and can be appropriately selected according to the purpose. Examples of the material of the cover sheet include, but not limited to, polyolefin resin, polyester resin, polystyrene resin, and polyamide resin. The cover sheet is preferably sized to be slightly larger than the multi-well plate lid and located inside an outer frame of the multi-well plate. The adhesive for adhering the cover sheet to the multi-well plate is applied to an outside of the multi-well plate lid. Such a configuration allows the cover sheet to adhere to the multi-well plate without adhering to the multi-well plate lid. With such a configuration, the cover sheet can be peeled off without affecting the multi-well plate lid when the multi-well plate is used.

When the multi-well plate according to an embodiment of the present disclosure is used, first, the cover sheet is peeled off and then the multi-well plate lid is peeled off to use the multi-well plate. When the multi-well plate lid is peeled off, for example, a user pinches the protruding portion with fingers, holds an unused portion of the multi-well plate lid with other fingers, and peels a target portion of the multi-well plate lid along the perforations to use the multi-well plate. In addition, it is also possible to temporarily peel off the multi-well plate lid, performs treatment on exposed wells, and then use the peeled multi-well plate lid again. A peeling jig may also be used to peel off the multi-well plate lid. The peeling jig includes a peeler, a slider, and a holder. With the peeling jig, a user slides the peeler with the slider while holding a non-target portion of the multi-well plate lid covering non-peeling target wells with the holder, thus allowing a peeling target portion of the multi-well plate lid covering peeling target wells to be efficiently and easily peeled off.

The multi-well plate according to an embodiment of the present disclosure is widely usable in, for example, biotechnology-related industries, life science industries, and medical industries, and is suitably used for, for example, PCR plates, cell culture plates, and calibration standard plates.

Multi-Well Plate Lid Set

A multi-well plate lid set according to an embodiment of the present disclosure includes: a multi-well plate lid to cover a plurality of wells of a multi-well plate and a cover sheet disposed on a first surface of the multi-well plate lid opposite to a second surface (well-side surface) of the multi-well plate lid facing the multi-well plate. The second surface of the multi-well plate lid facing the multi-well plate includes a region having a higher viscosity than a viscosity of the cover sheet or having a greater adhesive strength than an adhesive strength of the cover sheet. As the multi-well plate lid of the multi-well plate lid set, the multi-well plate lid according to an embodiment of the present disclosure is used. As the cover sheet of the multi-well plate lid set, the same cover sheet as the cover sheet in the multi-well plate according to an embodiment of the present disclosure is used.

Here, examples of the multi-well plate lid and the multi-well plate according to embodiments of the present disclosure is described with reference to the drawings. In the drawings, the same reference numerals are given to the same components, and redundant explanation may be omitted. Further, the number, position, shape, and so forth of the following components are not limited to the embodiments described below, and can be set to any other preferable number, position, shape, and so forth for carrying out the present invention.

Embodiment 1

Figure 1B:
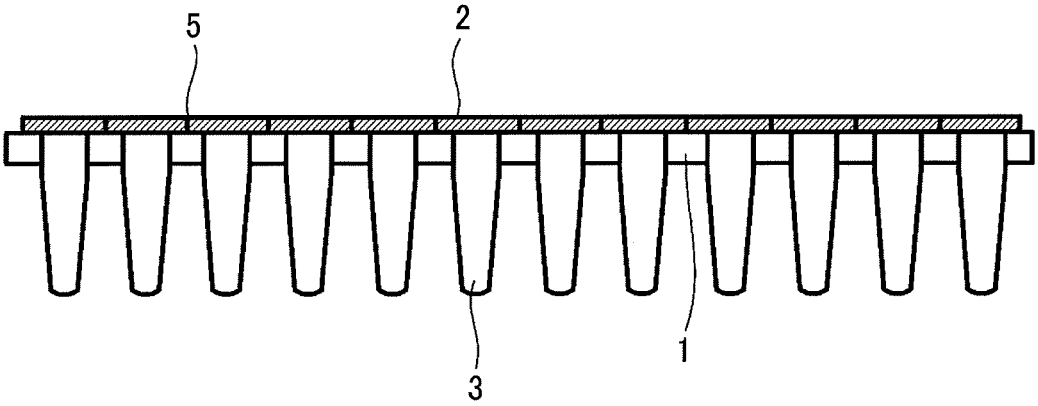
FIG. 1B is a side view of the multi-well plate of FIG. 1A.
Figure 1C:
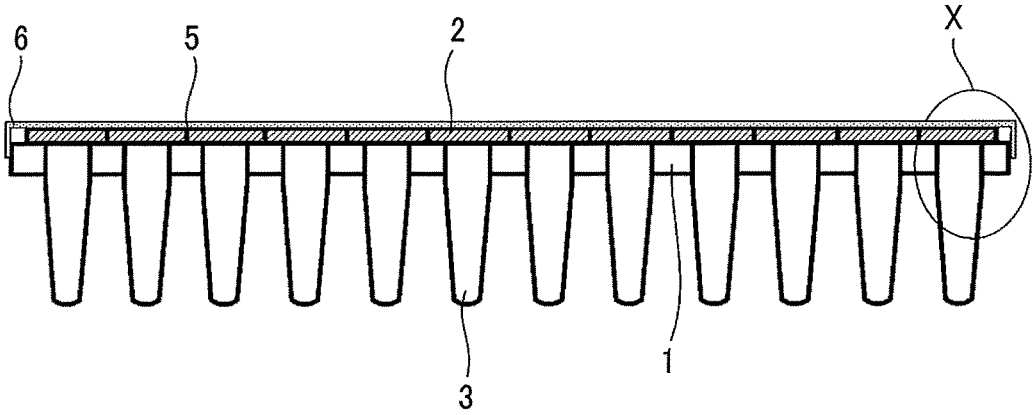
FIG. 1C is a side view of a state in which a cover sheet is disposed on the multi-well plate lid of FIG. 1A.
Figure 1D:
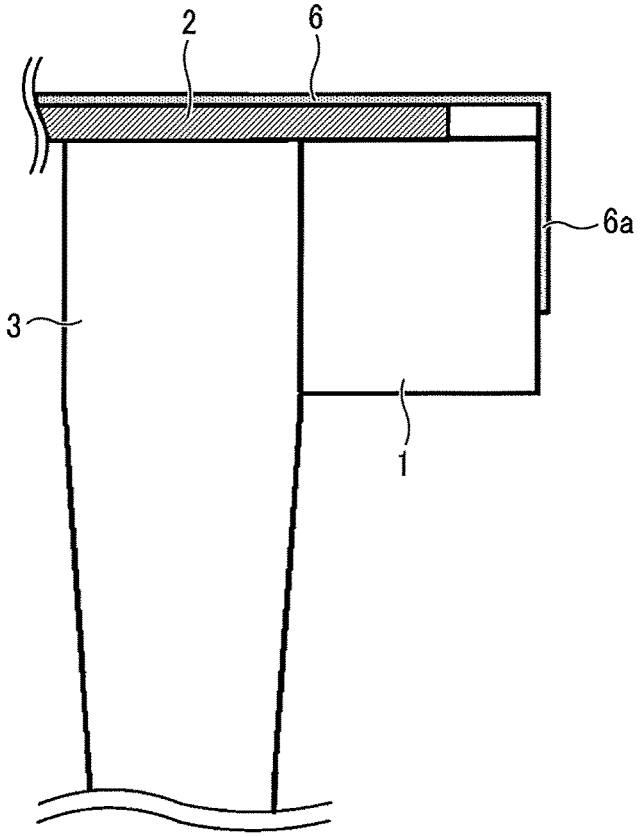
FIG. 1D is an enlarged view of a portion X in FIG. 1C.

FIG. 1A is an illustration of an example of a multi-well plate having the multi-well plate lid according to Embodiment 1 of the present disclosure. FIG. 1B is a side view of the multi-well plate of FIG. 1A. FIG. 1C is a side view of the multi-well plate of FIG. 1B with a cover sheet. FIG. 1D is an enlarged view of a portion indicated by X in FIG. 1C; In the present embodiment, a multi-well plate lid 2 is a sheet-shaped member having a size capable of covering all wells 3 of a multi-well plate 1. The multi-well plate lid 2 has perforations 5 and protruding portions 4. The multi-well plate 1 is a plate made of polypropylene resin. The multi-well plate 1 has a size of 80 mm×120 mm and includes 96 wells 3. In FIGS. 1A to 1C, the multi-well plate with 96 wells are depicted. However, the number of wells of the multi-well plate is not limited to 96, and may be 24, 48, 96, or 384.

Figure 2:
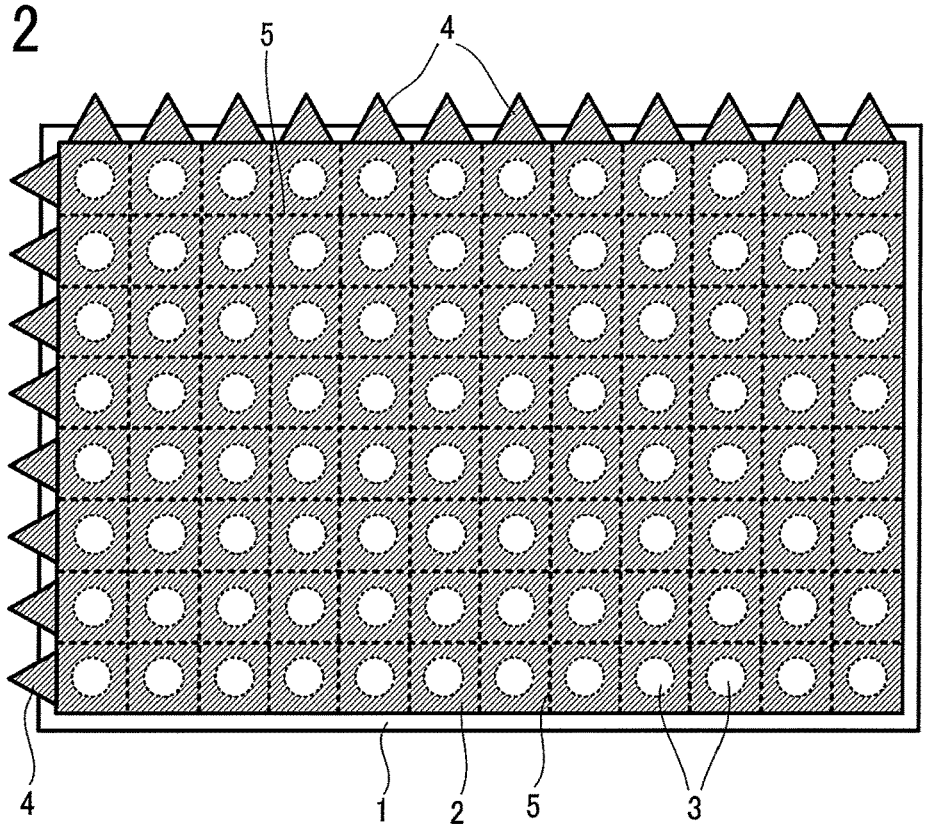
FIG. 2 is a plan view of the multi-well plate having the multi-well plate lid according to another embodiment of the present disclosure.
Figure 3:
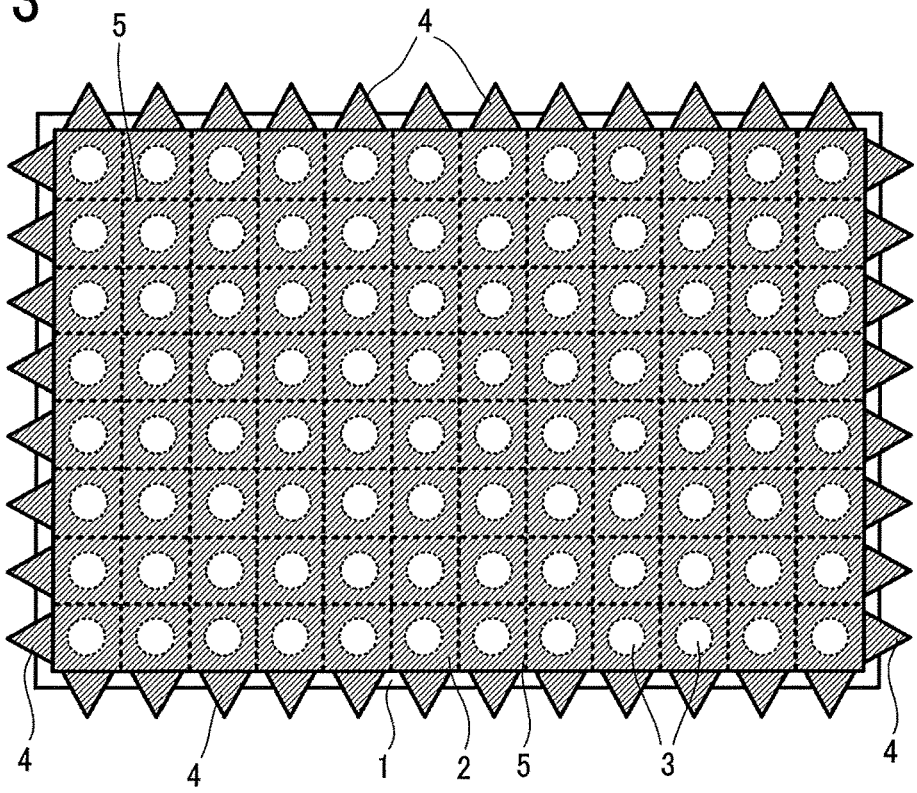
FIG. 3 is a plan view of the multi-well plate having the multi-well plate lid according to another embodiment of the present disclosure.
Figure 6:
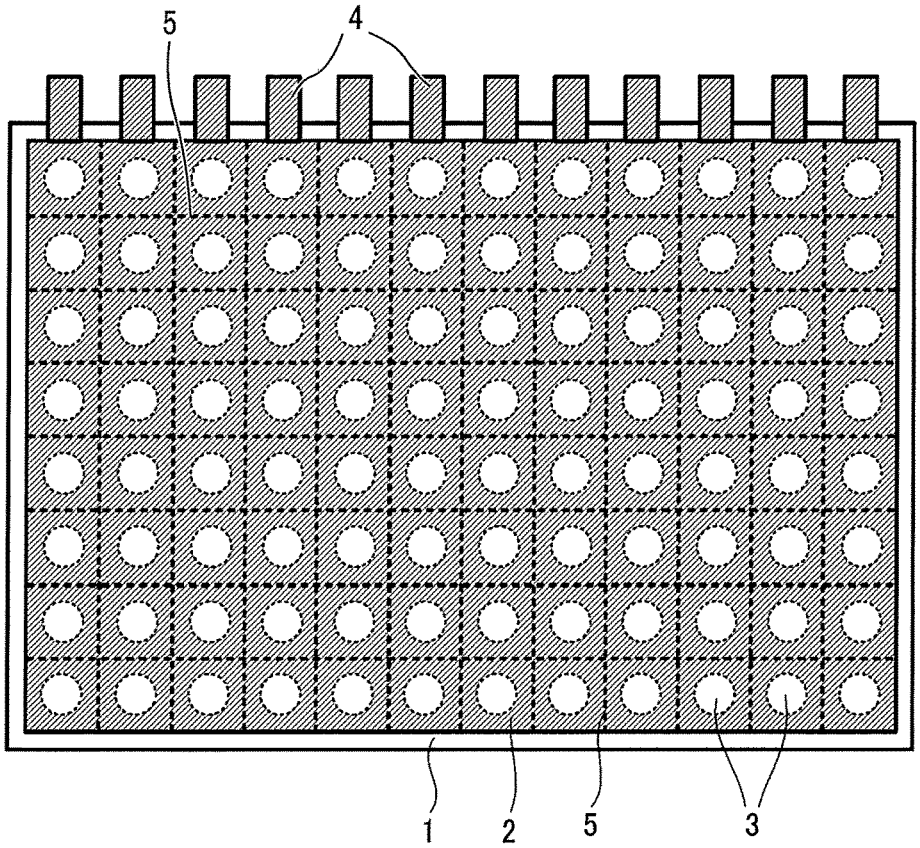
FIG. 6 is a plan view of the multi-well plate having the multi-well plate lid according to another embodiment of the present disclosure.
Figure 7:
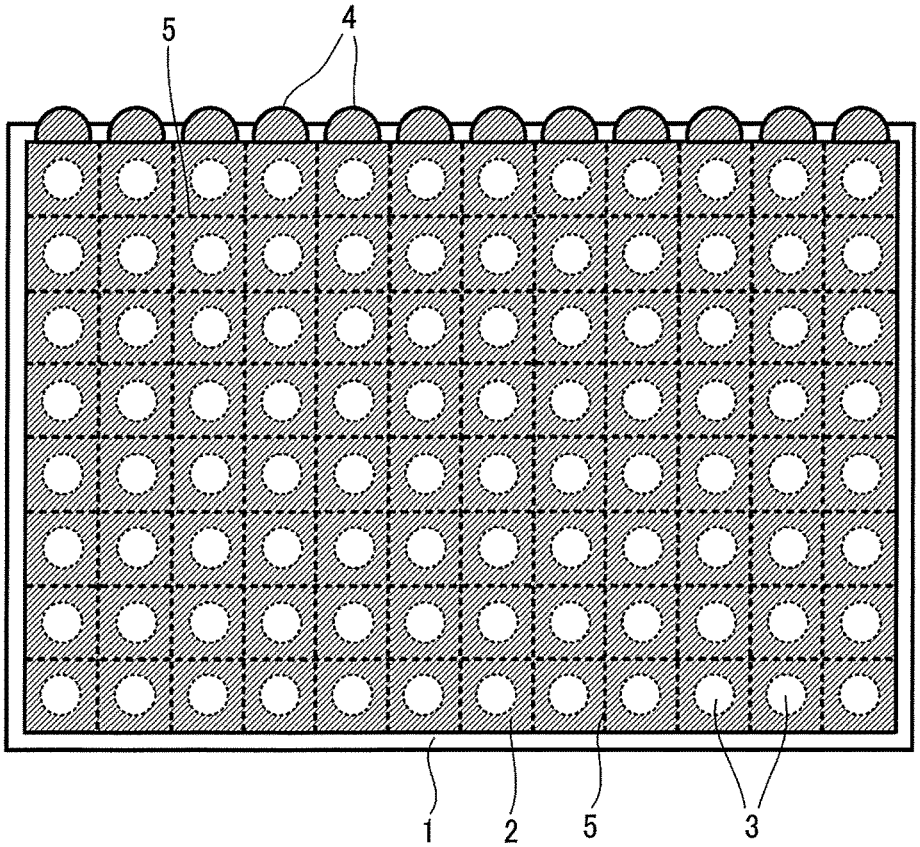
FIG. 7 is a plan view of the multi-well plate having the multi-well plate lid according to another embodiment of the present disclosure.

The multi-well plate lid 2 is an elastomer (silicone rubber sheet, BA grade, manufactured by Shin-Etsu Polymer Co., Ltd.) and has an average thickness of 2 mm. The protruding portions 4 protrude from an end(s) of the multi-well plate lid 2. As illustrated in FIGS. 1A, 2 and 3, the protruding portions 4 may be arranged along at least one of ends of the multi-well plate 1 in the longitudinal direction of the multi-well plate 1 and ends of the multi-well plate 1 in the width direction of the multi-well plate 1 so as to protrude from the at least one end. The protruding portions 4 has, e.g., a triangular shape and is integrally formed of the same material as the multi-well plate lid 2. Note that, in some embodiments, the protruding portion 4 may be rectangular as illustrated in FIG. 6 or semicircular as illustrated in FIG. 7.

Figure 4:
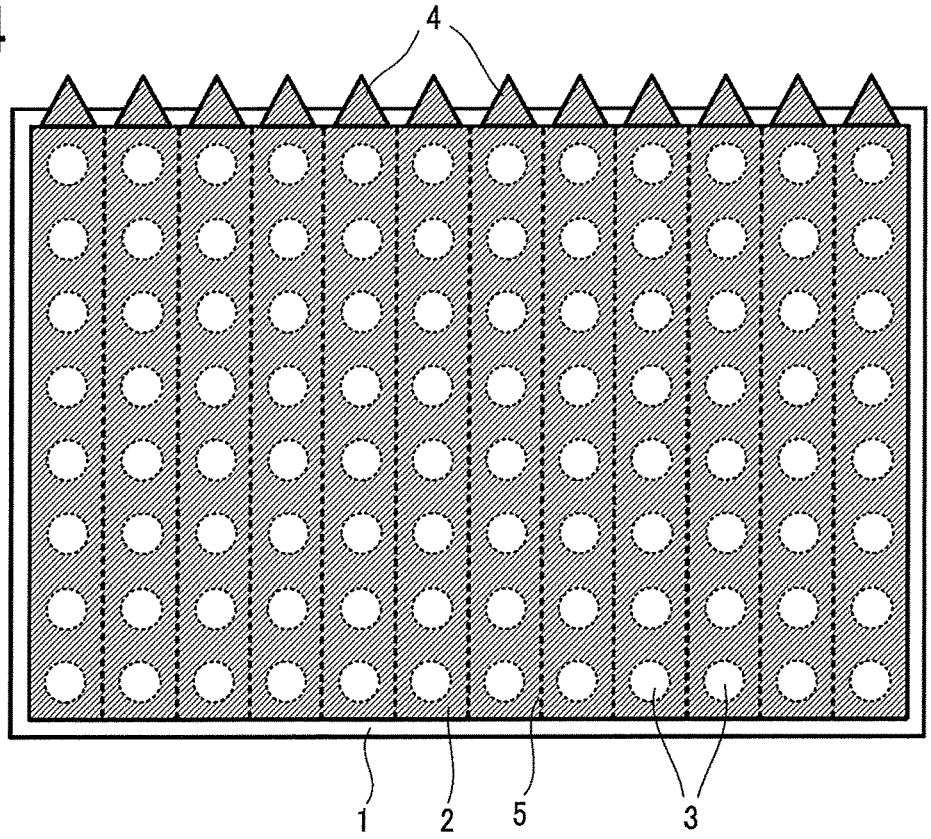
FIG. 4 is a plan view of the multi-well plate having the multi-well plate lid according to another embodiment of the present disclosure.
Figure 5:
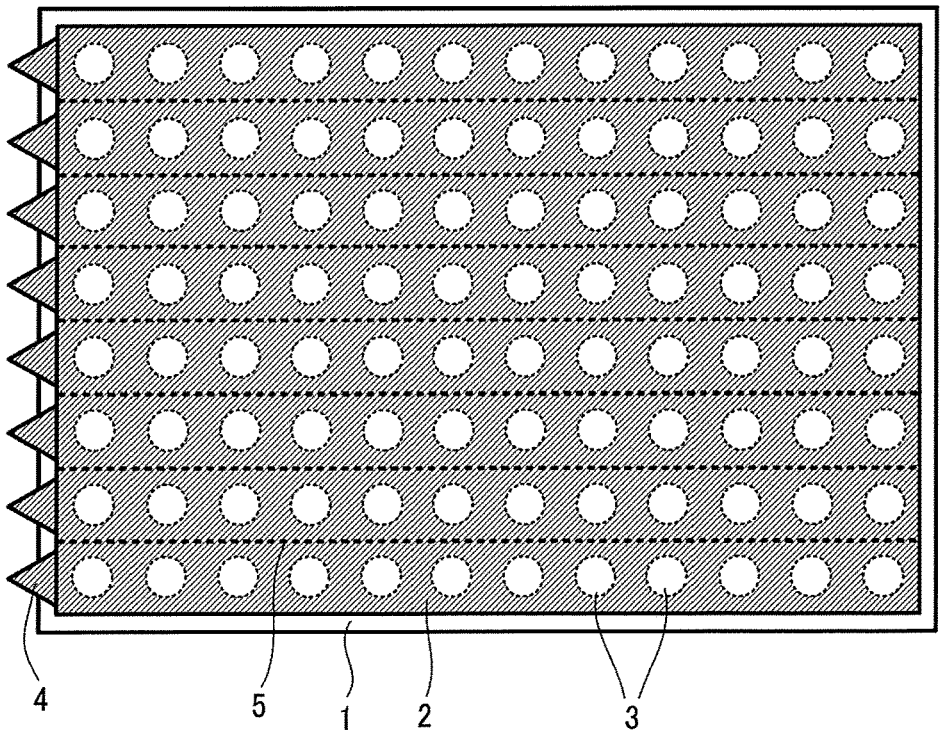
FIG. 5 is a plan view of the multi-well plate having the multi-well plate lid according to another embodiment of the present disclosure.

As illustrated in FIG. 1A, the perforations 5 are disposed surrounding the wells 3 so that the multi-well plate lid 2 can be peeled off for each well. Such a configuration is preferable in that a desired well can be arbitrarily used. As illustrated in FIGS. 4 and 5, the multi-well plate lid 2 preferably has the perforations 5 for separating each well row so that the multi-well plate lid can be unsealed (peeled off) for each well row in at least one of the longitudinal direction and the width direction of the multi-well plate 1. Such a configuration allows the multi-well plate lid to be peeled-off for each well row to use the multi-well plate. The pitch and size of perforations are not particularly limited and can be appropriately selected according to the purpose. When a peeling jig or other tool is used, the perforation size is preferably set to 0.1 mm or more and 0.4 mm or less. When a user cuts the multi-well plate lid by hand without using a peeing jig or other tool, the perforation size of approximately 2 mm or more and approximately 3 mm or less facilitates cutting of the multi-well plate lid. The perforation pitch is preferably substantially equal to the size of the perforation.

As a cover sheet 6, an adhesive plate seal for PCR (manufactured by NIPPON Genetics Co., Ltd.) is used. As illustrated in FIGS. 1C and 1D, the multi-well plate lid 2 is sized to be slightly smaller than the cover sheet 6 and located inside an outer frame of the multi-well plate 1. In such a configuration, since the adhesive for adhering the cover sheet 6 to the multi-well plate 1 is applied to an outer portion 6*a* outside the multi-well plate lid 2, the cover sheet 6 can adhere to the multi-well plate 1 without adhering to the multi-well plate lid 2. With such a configuration, the cover sheet 6 can be easily peeled off without affecting the multi-well plate lid 2 when the multi-well plate 1 is used.

Embodiment 1A

Figure 8A:
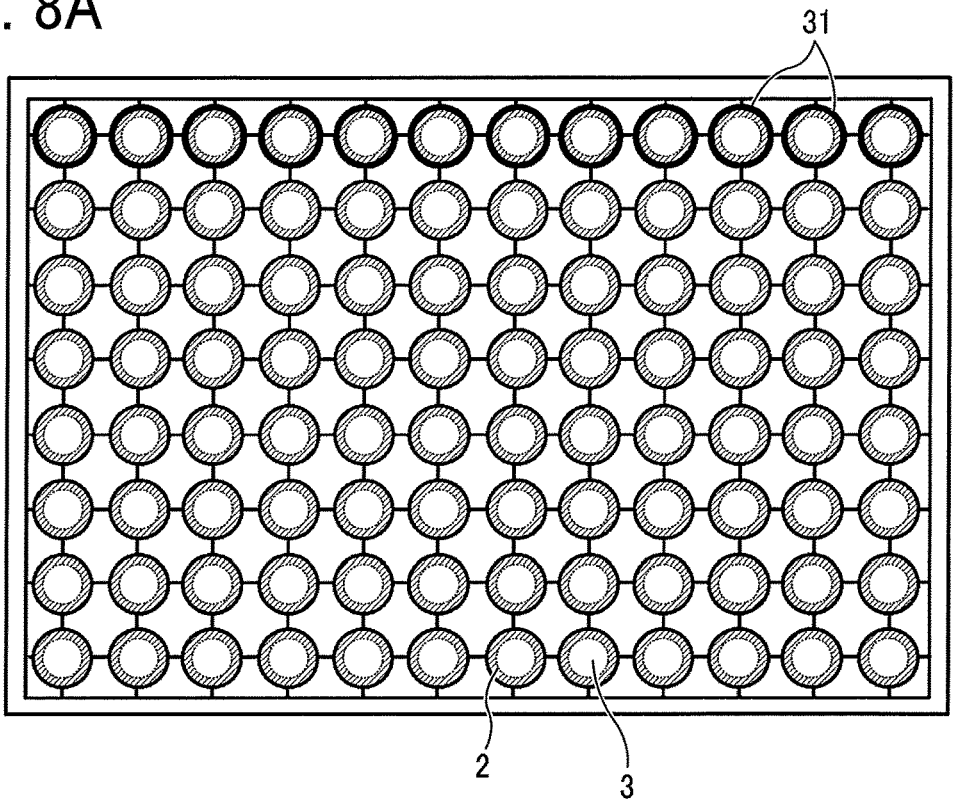
FIG. 8A is a plan view of the multi-well plate having the multi-well plate lid according to another embodiment of the present disclosure, in which an adhesive material is adhesively processed at inter-well portions.
Figure 8B:
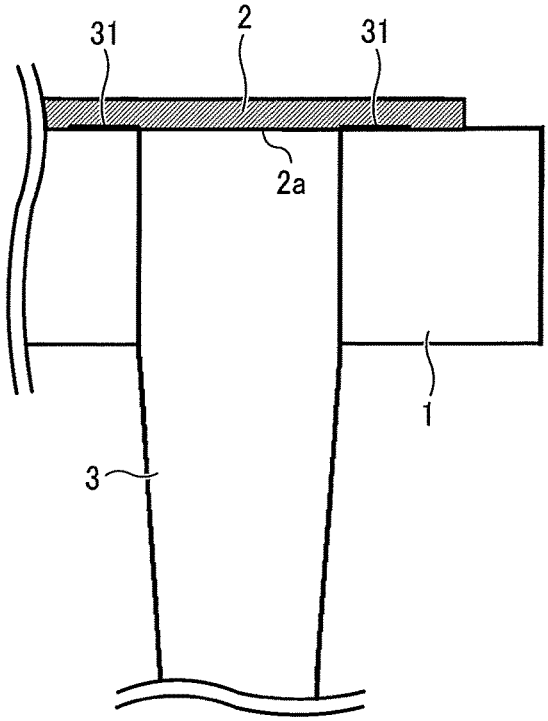
FIG. 8B is a partial enlarged side view of the multi-well plate of FIG. 8A.

FIG. 8A is an illustration of one example of the multi-well plate having the multi-well plate lid according to Embodiment 1A of the present disclosure. FIG. 8B is a partial enlarged side view of the multi-well plate of FIG. 8A. In FIG. 8A, the multi-well plate lid is illustrated without protruding portions. However, the multi-well plate lid may have protruding portions. As illustrated in FIGS. 8A and 8B, for wells from which the multi-well plate lid need not be unsealed (for example, wells not requiring reagent dispensing), an adhesive material (an acrylic emulsion adhesive, Cybinol, manufactured by Saiden Chemical Industry Co., Ltd.) is applied to a well-side surface 2*a* of the multi-well plate lid 2 facing the inter-well portions 31 that the multi-well plate lid 2 is to contact. After the application, the multi-well plate 1 is sealed with the multi-well plate lid 2 having the perforations. With such a configuration, the adhesive material can prevent the inter-well portions 31, which the multi-well plate lid 2 is to contact, of the wells not requiring reagent dispensing from being easily peeled off the multi-well plate lid. Accordingly, it is possible to prevent incorrect insertion of the reagent when the reagent is dispensed. Regarding the positions of the wells not requiring reagent dispensing, not only one row as illustrated in FIG. 8A but also a desired well(s) can be selected. Further, the shape of the perforations 5 illustrated in FIGS. 8A and 8B can prevent the multi-well plate lid 2 from being easily peeled off the inter-well portions 31, thus more reliably preventing incorrect insertion of a reagent when the reagent is dispensed. Regarding portions other than the surface portions to which the adhesive material is applied, the multi-well plate lid 2 can be easily peeled off similarly with Embodiment 1. As illustrated in FIG. 8B, the adhesive material is applied to the well-side surface 2*a* of the multi-well plate lid 2 corresponding to the inter-well portions 31 outside the edges of the wells 3. Such a configuration can prevent the multi-well plate lid 2 from being easily peeled off the inter-well portions 31, thus more reliably preventing incorrect insertion of a reagent when the reagent is dispensed. For the purpose of preventing incorrect reagent dispensing, it may be unnecessary to peel off the multi-well plate lid for wells containing, e.g., cells having a known number of copies of DNA. The configuration of the present embodiment can prevent the multi-well plate lid from being easily peeled off, thus reliably preventing mix-up of the wells. It is also preferable to color or mark wells containing, e.g., cells having a known number of copies of DNA to clearly visualize that the multi-well plate lid is not to be peeled off the wells. Note that the multi-well plate lid may cover all of the wells on the multi-well plate. In some embodiments, the multi-well plate lid may be configured to cover a specific well(s) on the multi-well plate (for example, a well(s) containing, e.g., cells having a known number of copies of DNA) and not to cover the other wells. In the present embodiment, the adhesive material is applied to the multi-well plate lid. When the multi-well plate lid is adhered to the multi-well plate, such a configuration can prevent the multi-well plate lid from being easily peeled off wells (non-peeling-target wells) from which the multi-well plate lid need not be peeled off, thus more reliably preventing incorrect dispensing. Note that, when the multi-well plate with the multi-well plate lid is provided, the configuration is not limited to the above-described configuration. For example, a configuration may be employed in which an adhesive member is disposed in a peripheral portion (and between adjacent wells) of non-peeling-target wells.

Embodiment 2

Figure 9A:
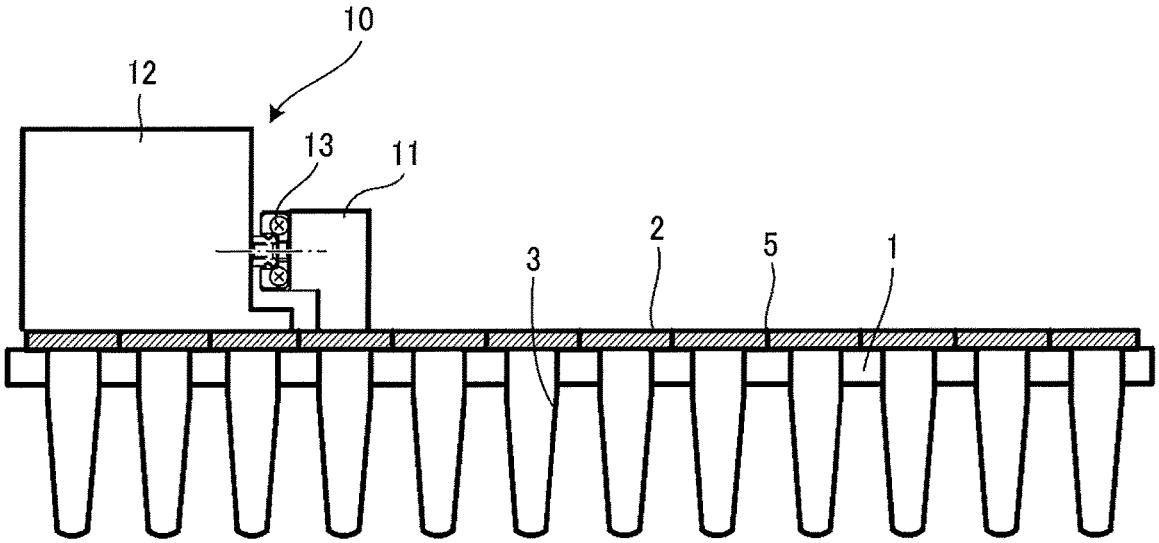
FIG. 9A is a side view of an example of a state of peeling the multi-well plate lid using a peeling jig.
Figure 9B:
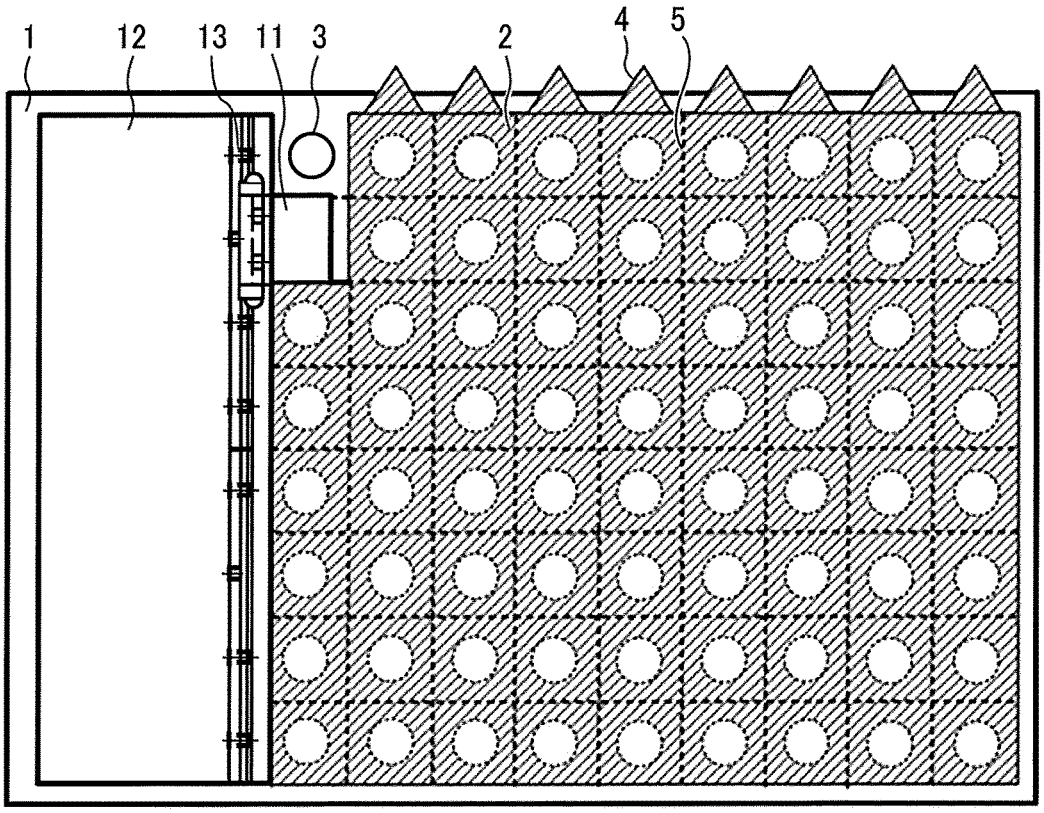
FIG. 9B is a plan view of the multi-well plate having the multi-well plate lid of FIG. 9A.
Figure 10:
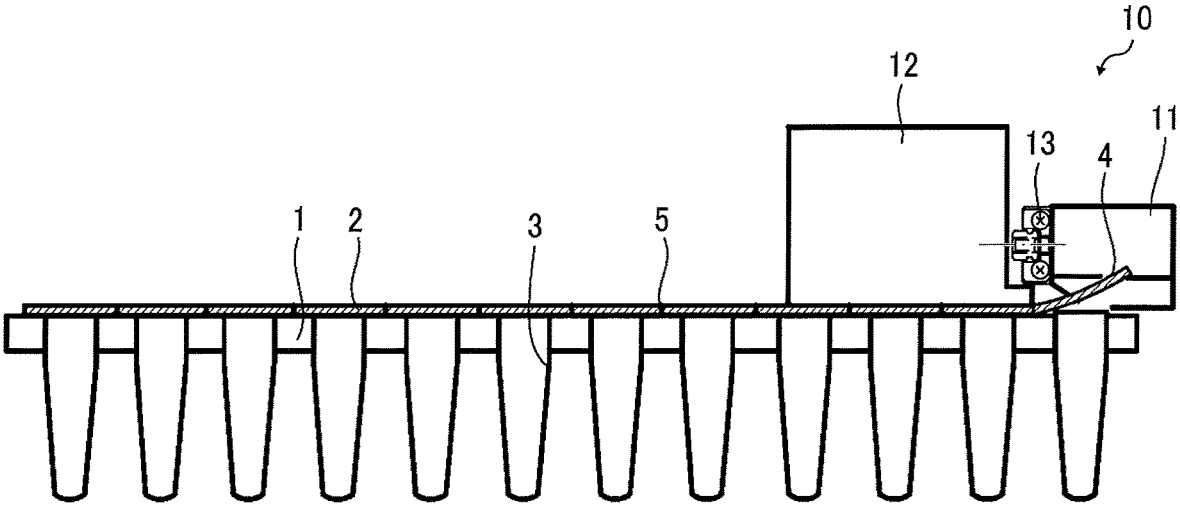
FIG. 10 is a side view of another example of a state in which the multi-well plate lid is peeled with the peeling jig to unseal a well.

As illustrated in FIGS. 9A and 9B, a peeling jig 10 includes a peeler 11, a slider 13, and a holder 12. By sliding the peeler 11 with the slider 13 while pressing a portion of the multi-well plate lid 2 covering the non-peeling-target wells with the holder 12, a portion of the multi-well plate lid 2 covering peeling-target wells, from which the multi-well plate lid 2 is to be peeled, can be peeled off the peeling-target wells. As illustrated in FIG. 10, the protruding portion 4 is secured at an end of the multi-well plate lid 2 to the peeler 11 of the peeling jig 10, thus allowing the multi-well plate lid 2 to be more easily peeled off the peeling-target wells.

Figure 11:
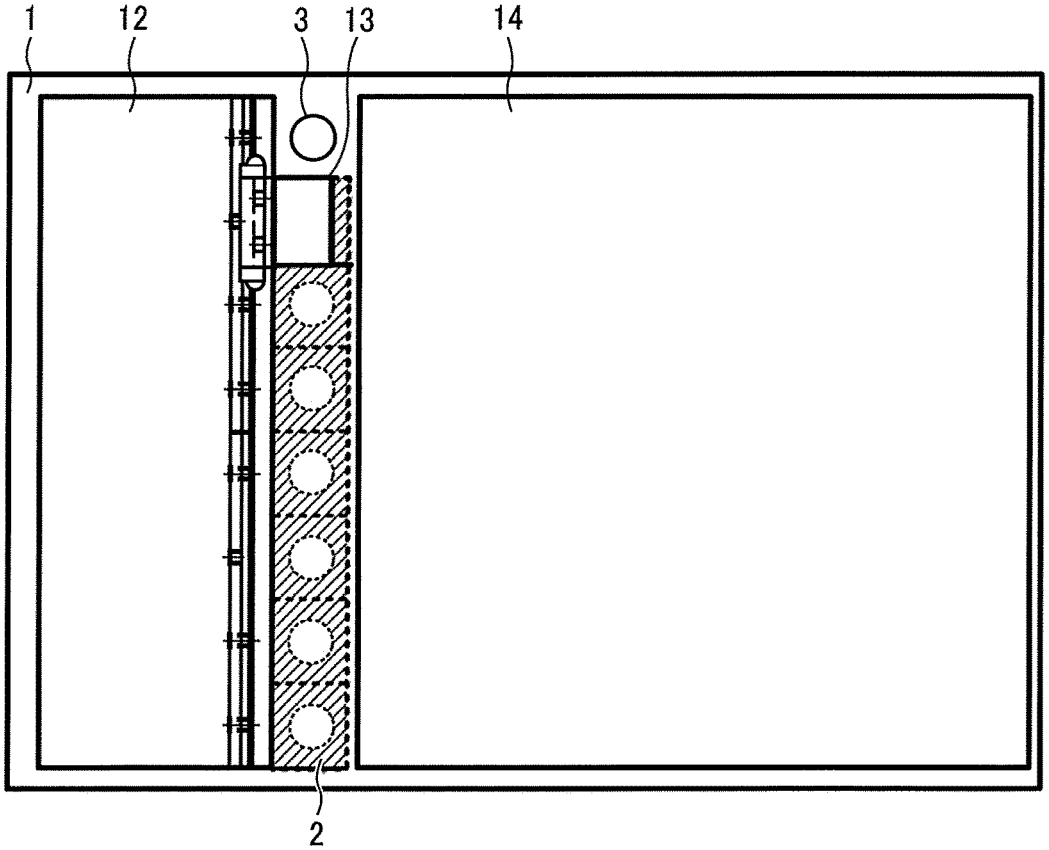
FIG. 11 is a plan view showing another example of a state in which only arbitrary well rows of the multi-well plate lid are peeled off using a peeling jig.

Instead of peeling off the multi-well plate lid 2, the well 3 can be temporarily unsealed with the peeling jig 10. Such a configuration allows the multi-well plate lid to be used again after the well 3 is unsealed, for example, in applications, such as dispensing different reagents for each half of the multi-well plate. In such a case, the perforations of the multi-well plate lid 2 allow the well 3 to be easily unsealed temporarily. As illustrated in FIG. 11, the slider 13 is slid with the peeling jig 10, the multi-well plate lid 2 can be peeled off only a desired well row(s) of the multi-well plate 1 by sliding the slider 13 with the peeling jig 10. Thus, when it is desired to use only a desired well row of the multi-well plate, the multi-well plate lid 2 can be peeled off only the desired well row. Note that, as illustrated in FIG. 11, the peeling jig 10 may include a second holder 14. In Embodiment 2, the same reference numerals are given to the same components as those of Embodiment 1 described above, and redundant description thereof are omitted.

Embodiment 3

Figure 12A:
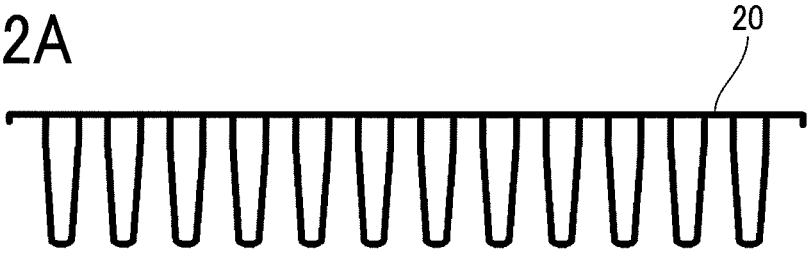
FIGS. 12A to 12C are schematic views of a method of covering wells with the multi-well plate lid having a projecting shape that is formed by pressing the multi-well plate lid with a projecting member.
Figure 12B:
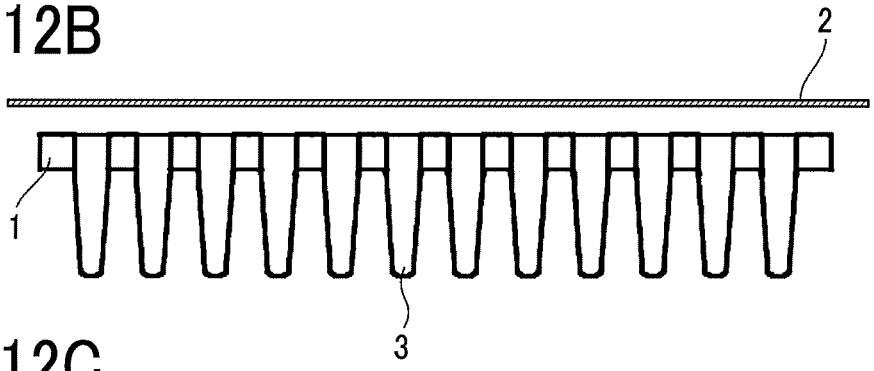
Figure 12C:
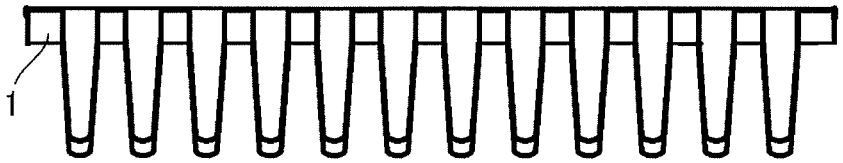

As illustrated in FIGS. 12A to 12C, the plurality of wells 3 of the multi-well plate 1 are covered with the multi-well plate lid 2 having a projecting shape. The projecting shape is formed by pressing the multi-well plate lid 2 with a projecting member 20. By pressing the projecting member 20 against the multi-well plate lid 2, the multi-well plate lid is deformed in a direction to reduce the volume of the wells. When the amount of reagent dispensed into the well is less than the volume of the well, such a configuration can restrict the movement of liquid dispensed in the well during transportation of the multi-well plate, thus preventing, e.g., cells in the dispensed liquid from adhering to an upper portion of the well. When the multi-well plate is transported after dispensing and freezing of the reagent, such a configuration can restrict the movement of liquid in the well, thus suppressing damage to the dispensed liquid. When the projecting member 20 is removed, the multi-well plate lid 2 restores from the projecting shape to the sheet shape and turns to be in the usable state described in the first embodiment. The material of the multi-well plate lid 2 used in Embodiment 3 is preferably a rubber-type elastic body that is greatly deformable and has resilience. The material of the projecting member 20 is not particularly limited and can be appropriately selected according to the purpose. In Embodiment 3, the same reference numerals are given to the same components as those of Embodiment 1 described above, and redundant description thereof are omitted.

Embodiment 4

Figure 13A:
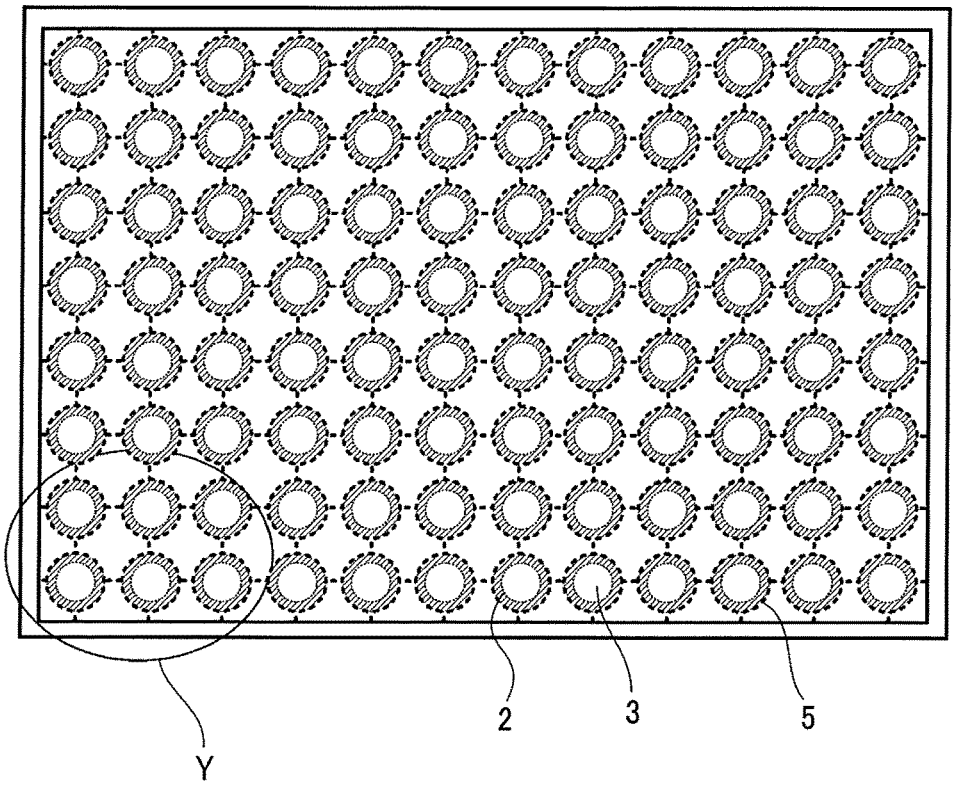
FIG. 13A is a plan view of the multi-well plate having the multi-well plate lid according to another embodiment of the present disclosure.
Figure 13B:
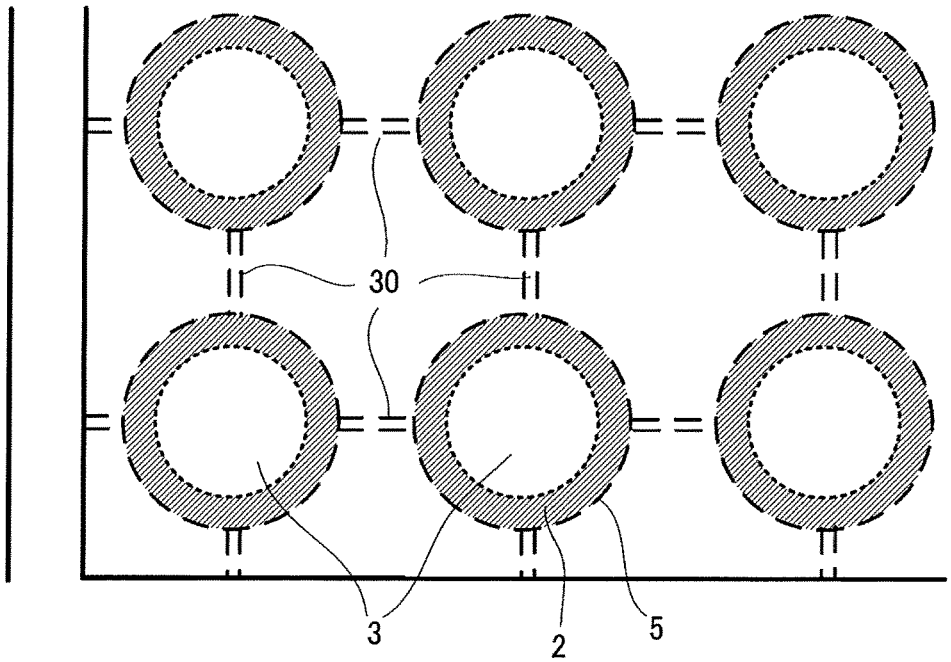
FIG. 13B is a partial enlarged plan view of a portion Y in FIG. 13A.

FIG. 13A is an illustration of one example of the multi-well plate having the multi-well plate lid according to Embodiment 4 of the present disclosure. FIG. 13B is a partial enlarged side view of a portion Y of FIG. 13A. In FIG. 13A, the protruding portions are not illustrated. As illustrated in FIGS. 13A and 13B, the shape of the perforations 5 in the multi-well plate lid 2 is a circular shape slightly larger than a hole diameter of the well 3 Accordingly, when a reagent is not put in a desired specific well, the multi-well plate lid 2 and the multi-well plate 1 are bonded with an adhesive. When the multi-well plate lid 2 is peeled off, it is easy to leave a portion of the multi-well plate lid 2 other than the desired specific well, thus facilitating the peeling of the multi-well plate lid 2. Connecting portions 30 connect adjacent circular perforations 5, thus facilitating the peeling of the multi-well plate lid 2 from the plurality of wells 30 at once. In Embodiment 4, the same reference numerals are given to the same components as those of Embodiment 1 described above, and redundant description thereof are omitted.

Aspects of the present disclosure are, for example, as follows.

Aspect 1

A multi-well plate lid according to an aspect of the present disclosure is a multi-well plate lid to cover a plurality of wells of a multi-well plate. The multi-well plate lid has a well-side surface including two or more regions with different adhesive strengths to the multi-well plate.

In the multi-well plate lid according to aspect 1, the adhesive strength of a covering portion to cover wells containing particles is greater than the adhesive strength of another covering portion to cover other wells.

Aspect 3

The multi-well plate lid according to aspect 1 or 2 further includes a perforation disposed between adjacent wells of the plurality of wells and a protruding portion protruding from an end of the multi-well plate lid.

Aspect 4

In the multi-well plate lid according to aspect 2 or 3, the particles include at least DNAs having a specific nucleotide sequence.

Aspect 5 In the multi-well plate lid according to aspect 4, the number of copies of the DNAs having the specific nucleotide sequence is a counted known number.

Aspect 6

In the multi-well plate lid according to any one of aspects 2 to 5, the particles include at least cells.

Aspect 7

In the multi-well plate lid according to aspect 6, the number of copies of the cells is a counted known number.

Aspect 8

A multi-well plate lid includes a perforation disposed between adjacent wells of a plurality of wells of a multi-well plate; and an adhesive member to adhere the multi-well plate and the multi-well plate lid.

Aspect 9

The multi-well plate lid according to aspect 8 further includes a protruding portion protruding from an end of the multi-well plate lid.

Aspect 10

In the multi-well plate lid according to aspect 8 or 9, the multi-well plate lid is unsealable for each well of the plurality of wells.

Aspect 11

In the multi-well plate lid according to any one of aspects 8 to 10, the multi-well plate lid is unsealable for each well row in at least one of a longitudinal direction and a width direction of the multi-well plate.

Aspect 12

In the multi-well plate lid according to any one of aspects 3 to 7 and 9 to 11, the multi-well plate lid is unsealable for each well row in at least one of a longitudinal direction and a width direction of the multi-well plate.

Aspect 13

In the multi-well plate lid according to any one of aspects 1 to 12, the multi-well plate lid is made of an elastomer.

Aspect 14

In the multi-well plate lid according to any one of aspects 1 to 13, the well-side surface is water-repellent treated with a water repellent material.

Aspect 15

In the multi-well plate lid according to any one of aspects 2 to 14, the multi-well plate lid is unsealed by peeling a portion of the multi-well plate lid covering wells not containing particles while holding a portion of the multi-well plate lid covering wells containing particles with a peeling jig.

Aspect 16

In the multi-well plate lid according to any one of aspects 1 to 15, the multi-well plate lid has a protruding shape formed along a protruding member pressed against the multi-well plate lid.

Aspect 17

A multi-well plate lid set includes a multi-well plate lid to cover a plurality of wells of a multi-well plate; and a cover sheet disposed on a first surface of the multi-well plate lid opposite a second surface of the multi-well plate lid facing the multi-well plate. The second surface includes a region having a higher viscosity or a greater adhesive strength than the cover sheet.

Aspect 18

A multi-well plate includes a plurality of wells and the multi-well plate lid according to any one of aspects 1 to 16 covering the plurality of wells.

Aspect 19

The multi-well plate according to aspect 18 further includes a cover sheet disposed on the multi-well plate lid.

Aspect 20

The multi-well plate according to any one of aspects 8 to 19 further includes particles contained in the plurality of wells. The particles include at least cells.

Aspect 21

In the multi-well plate according to aspect 20, the number of copies of the cells is a counted known number.

Aspect 22

The multi-well plate according to aspect 20 or 21 further includes particles contained in the plurality of wells. The particles are at least DNAs having a specific nucleotide sequence.

Aspect 23

In the multi-well plate according to aspect 22, the number of copies of the DNAs having the specific nucleotide sequence is a counted known number.

Aspect 24

In the multi-well plate according to any one of aspects 18 to 23, the number of the plurality of wells is 24, 48, 96, or 384.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A multi-well plate, comprising:

a plurality of wells; and a multi-well plate lid, comprising:

a well-side surface to cover the plurality of wells, and perforations surrounding each well, wherein the well-side surface includes two or more regions with different adhesive strengths to the multi-well plate;

the well-side surface includes:

a first covering portion to cover a well of the plurality of wells that contains particles; and a second covering portion to cover another well of the plurality of wells that contains no particles, and an adhesive strength of the first covering portion is greater than an adhesive strength of the second covering portion, the adhesive strength of the second covering portion is greater than having no adhesive strength.

2. The multi-well plate according to claim 1, further comprising:

a protruding portion protruding from an end of the multi-well plate lid.

3. The multi-well plate according to claim 1, further comprising a plurality of protruding portions arranged along at least one end of ends of the multi-well plate in a longitudinal direction and a width direction of the multi-well plate, to protrude from the at least one end.

4. The multi-well plate according to claim 1, wherein the well-side surface is water-repellent treated with a water repellent material.

5. A multi-well plate, comprising:

a plurality of wells; and a multi-well plate lid comprising:

perforations surrounding each well of the plurality of wells; and an adhesive member to adhere to the multi-well plate and the multi-well plate lid;

the adhesive member includes:

a first covering portion to cover a well of the plurality of wells that contains particles; and a second covering portion to cover another well of the plurality of wells that contains no particles, and an adhesive strength of the first covering portion is greater than an adhesive strength of the second covering portion, the adhesive strength of the second covering portion is greater than having no adhesive strength.

6. The multi-well plate according to claim 1, wherein the multi-well plate lid has a protruding shape formed along a protruding member pressed against the multi-well plate lid.

7. The multi-well plate according to claim 1, further comprising a cover sheet disposed on the multi-well plate lid.

8. The multi-well plate according to claim 1, further comprising particles contained in the plurality of wells, wherein the particles include at least cells.

9. The multi-well plate according to claim 8, wherein a number of copies of the cells is a counted known number.

10. The multi-well plate according to claim 1, further comprising particles contained in the plurality of wells, wherein the particles are at least DNAs having a specific nucleotide sequence.

11. The multi-well plate according to claim 10, wherein a number of copies of the DNAs having the specific nucleotide sequence is a counted known number.

12. The multi-well plate according to claim 5, further comprising a protruding portion protruding from an end of the multi-well plate lid.

13. The multi-well plate according to claim 12, wherein the multi-well plate lid is unsealable for each well row in at least one of a longitudinal direction and a width direction of the multi-well plate.

14. The multi-well plate according to claim 5, wherein the multi-well plate lid is unsealable for each well of the plurality of wells.

15. The multi-well plate according to claim 5, wherein the multi-well plate lid is unsealable for each well row in at least one of a longitudinal direction and a width direction of the multi-well plate.

16. The multi-well plate according to claim 5, wherein the multi-well plate lid is made of an elastomer.

17. The multi-well plate according to claim 5, wherein the well-side surface is water-repellent treated with a water repellent material.

18. A multi-well plate set, comprising:

a multi-well plate, comprising:

a plurality of wells; and a multi-well plate lid to cover the plurality of wells; and a cover sheet disposed on a first surface of the multi-well plate lid opposite a second surface of the multi-well plate lid facing the multi-well plate, wherein the second surface includes a region having a higher viscosity or a greater adhesive strength than the cover sheet, and the multi-well plate lid includes perforations surrounding each well of the plurality of wells;

the second surface includes:

a first covering portion to cover a well of the plurality of wells that contains particles; and a second covering portion to cover another well of the plurality of wells that contains no particles, and an adhesive strength of the first covering portion is greater than an adhesive strength of the second covering portion, the adhesive strength of the second covering portion is greater than having no adhesive strength.

* * * * *